US009771627B2

(12) United States Patent
Matusewicz et al.

(10) Patent No.: US 9,771,627 B2
(45) Date of Patent: Sep. 26, 2017

(54) LANCES FOR TOP SUBMERGED INJECTION

(75) Inventors: Robert Matusewicz, Oakleigh (AU); Markus Reuter, Helsinki (FI)

(73) Assignee: Outotec Oyj, Espoo (FI)

( * ) Notice: Subject to any disclaimer, the term of this patent is extended or adjusted under 35 U.S.C. 154(b) by 310 days.

(21) Appl. No.: 14/342,340

(22) PCT Filed: Aug. 28, 2012

(86) PCT No.: PCT/AU2012/001001

§ 371 (c)(1),
(2), (4) Date: Jun. 4, 2014

(87) PCT Pub. No.: WO2013/029092

PCT Pub. Date: Mar. 7, 2013

(65) Prior Publication Data

US 2014/0284852 A1 Sep. 25, 2014

(30) Foreign Application Priority Data

Sep. 2, 2011 (AU) ..... 2011903569

(51) Int. Cl.

| | |
|---|---|
| ***C21C 5/46*** | (2006.01) |
| ***C22B 9/05*** | (2006.01) |
| *F27D 3/16* | (2006.01) |

(52) U.S. Cl.

CPC ..... *C21C 5/4606* (2013.01); *C21C 5/4613* (2013.01); *C22B 9/05* (2013.01);
(Continued)

(58) Field of Classification Search

CPC ..... C21C 2005/4626; C21C 5/4606; C21C 5/4613; C22B 9/05; F27D 2003/162; F27D 2003/168; F27D 2003/169
(Continued)

(56) References Cited

U.S. PATENT DOCUMENTS

| | | | |
|---|---|---|---|
| 3,223,398 | A | 12/1965 | Bertram et al. |
| 3,269,829 | A | 8/1966 | Belkin |

(Continued)

FOREIGN PATENT DOCUMENTS

| | | |
|---|---|---|
| AU | 707438 B2 | 7/1999 |
| CN | 1051081 | 5/1991 |

(Continued)

OTHER PUBLICATIONS

Office Action from corresponding Chinese patent application No. 201280042180.9, dated Sep. 3, 2014, with English translation (17 pages).

(Continued)

*Primary Examiner* — Scott Kastler
*Assistant Examiner* — Michael Aboagye
(74) *Attorney, Agent, or Firm* — Chernoff Vilhauer LLP

(57) ABSTRACT

A lance (10), for conducting a pyrometallurgical operation by top submerged lancing (TSL) injection, wherein the lance (10) has at least an inner pipe (12) and outer pipe (14) which are substantially concentric. The lower outlet of the inner pipe (12) is set at a level relative to the lower, outlet end of the outer pipe (14) required for pyrometallurgical operation. The lance (10) further includes a shroud (22) through which the outer pipe (14) extends and which is mounted on and extends along an upper portion of the outer pipe (14) to define with the outer pipe (14) a passageway (28) along which gas is able to be supplied for flow towards the outlet end of the outer pipe (14) for discharge exteriorly of the lance (10). The shroud (22) is longitudinally adjustable relative to the outer pipe (14) to enable substantial maintenance of, or variation in, a longitudinal spacing between the outlet ends of the shroud (22) and the outer pipe (14).

21 Claims, 4 Drawing Sheets

(52) U.S. Cl.
CPC ..... *C21C 2005/4626* (2013.01); *F27D 2003/162* (2013.01); *F27D 2003/168* (2013.01); *F27D 2003/169* (2013.01)

(58) Field of Classification Search
USPC ..... 266/99, 225, 226
See application file for complete search history.

(56) References Cited

U.S. PATENT DOCUMENTS

| | | | | |
|---|---|---|---|---|
| 3,321,139 | A | 5/1967 | De Saint Martin | |
| 3,338,570 | A | 8/1967 | Zimmer | |
| 3,411,716 | A | 11/1968 | Stephan et al. | |
| 3,488,044 | A | 1/1970 | Shepherd | |
| 3,521,872 | A | 7/1970 | Themelis | |
| 3,620,455 | A * | 11/1971 | Berry | C21C 5/4606 239/132.3 |
| 3,730,505 | A | 5/1973 | Ramacciotti et al. | |
| 3,802,681 | A | 4/1974 | Pfeifer | |
| 3,828,850 | A | 8/1974 | McMinn et al. | |
| 3,876,190 | A | 4/1975 | Johnstone et al. | |
| 3,889,933 | A | 6/1975 | Jaquay | |
| 4,023,676 | A | 5/1977 | Bennett et al. | |
| 4,097,030 | A | 6/1978 | Desaar | |
| 4,251,271 | A * | 2/1981 | Floyd | C21C 5/4613 266/225 |
| 4,303,230 | A * | 12/1981 | Bleloch | C21C 5/4606 266/270 |
| 4,326,701 | A | 4/1982 | Hayden, Jr. et al. | |
| 4,396,182 | A | 8/1983 | Schaffar et al. | |
| 4,541,617 | A | 9/1985 | Okane et al. | |
| 5,251,879 | A * | 10/1993 | Floyd | C21C 5/4613 266/225 |
| 5,308,043 | A | 5/1994 | Floyd et al. | |
| 5,498,277 | A | 3/1996 | Floyd | |
| 5,615,626 | A * | 4/1997 | Floyd | F23G 5/085 110/346 |
| 5,680,766 | A | 10/1997 | Joshi et al. | |
| 6,066,771 | A * | 5/2000 | Floyd | A62D 3/38 110/341 |
| 6,368,550 | B1 * | 4/2002 | Wagener | C21C 5/4606 266/225 |
| 6,565,800 | B2 | 5/2003 | Dunne | |
| 9,528,766 | B2 * | 12/2016 | Matusewicz | C21C 5/4613 |
| 2014/0151942 | A1 * | 6/2014 | Matusewicz | C21C 5/4613 266/99 |

FOREIGN PATENT DOCUMENTS

| | | | |
|---|---|---|---|
| EP | 0535846 | A2 | 4/1993 |
| EP | 0597270 | A2 | 5/1994 |
| EP | 0644269 | A1 | 9/1994 |
| FR | 2432552 | | 2/1980 |
| GB | 876687 | A | 9/1961 |
| WO | 93/06251 | A1 | 4/1993 |
| WO | 9802588 | A1 | 1/1998 |
| WO | 0181637 | A1 | 11/2001 |
| WO | 03091460 | A1 | 11/2003 |
| WO | 2006042363 | A1 | 4/2006 |

OTHER PUBLICATIONS

Office Action from corresponding Japanese patent application No. 2014-527434, dated Dec. 2, 2014, with English translation (5 pages).
International Search Report for PCT/AU2012/001001 completed Sep. 14, 2012, dated Sep. 17, 2012, 4 pages.
International Search Report for PCT/AU2012/000751 completed Jul. 24, 2012, dated Jul. 27, 2012, 4 pages.
International Search Report for PCT/IB2012/056714 completed Mar. 11, 2013, dated Mar. 18, 2013, 5 pages.

* cited by examiner

LANCES FOR TOP SUBMERGED INJECTION

CROSS-REFERENCE TO RELATED APPLICATION

This is a national stage application filed under 35 USC 371 based on International Application No. PCT/AU2012/001001 filed Aug. 28, 2012, and claims priority under 35 USC 119 of Australian Patent Application No. 2011903569 filed Sep. 2, 2011.

FIELD OF THE INVENTION

This invention relates to top submerged injecting lances for use in molten bath pyrometallurgical operations.

BACKGROUND TO THE INVENTION

Molten bath smelting or other pyrometallurgical operations which require interaction between the bath and a source of oxygen-containing gas utilize several different arrangements for the supply of the gas. In general, these operations involve direct injection into molten matte/metal. This may be by bottom blowing tuyeres as in a Bessemer type of furnace or side blowing tuyeres as in a Peirce-Smith type of converter. Alternatively, the injection of gas may be by means of a lance to provide either top blowing or submerged injection. Examples of top blowing lance injection are the KALDO and BOP steel making plants in which pure oxygen is blown from above the bath to produce steel from molten iron. Another example of top blowing lance injection is provided by the smelting and matte converting stages of the Mitsubishi copper process, in which injection lances cause jets of oxygen-containing gas such as air or oxygen-enriched air to impinge on and penetrate the top surface of the bath, respectively to produce and convert copper matte. In the case of submerged lance injection, the lower end of the lance is submerged so that injection occurs within rather than from above a slag layer of the bath, to provide top submerged lancing (TSL) injection, a well known example of which is the Outotec Ausmelt TSL technology which is applied to a wide range of metals processing.

With both forms of injection from above, that is, top blowing and TSL injection, the lance is subjected to intense prevailing bath temperatures. The top blowing in the Mitsubishi copper process uses a number of relatively small steel lances which have an inner pipe of about 50 mm diameter and an outer pipe of about 100 mm diameter. The inner pipe terminates at about the level of the furnace roof, well above the reaction zone. The outer pipe, which is rotatable to prevent it sticking to a water-cooled collar at the furnace roof, extends down into the gas space of the furnace to position its lower end about 500-800 mm above the upper surface of the molten bath. Particulate feed entrained in air is blown through the inner pipe, while oxygen enriched air is blown through the annulus between the pipes. Despite the spacing of the lower end of the outer pipe above the bath surface, and any cooling of the lance by the gases passing through it, the outer pipe burns back by about 400 mm per day. The outer pipe therefore is slowly lowered and, when required, new sections are attached to the top of the outer, consumable pipe.

The lances for TSL injection are much larger than those for top blowing processes such as the Mitsubishi process described above. A TSL lance usually has at least an inner and an outer pipe, as assumed in the following, but may have at least one other pipe concentric with the inner and outer pipes. Typical large scaleTSL lances have an outer pipe diameter of 200 to 500 mm, or larger. Also, the lance is much longer and extends down through the roof of a TSL reactor, which may be about 10 to 15 m tall, so that the lower end of the outer pipe is immersed to a depth of about 300 mm or more in a molten slag phase of the bath. A lower extent of the TSL Lance, including the submerged portion is protected by a coating of solidified or frozen slag formed and maintained on the outer surface of the outer pipe by the cooling action of the injected gas flow. The inner pipe may terminate at about the same level as the outer pipe, or at a higher level of up to about 1000 mm above the lower end of the outer pipe. Thus, it can be the case that the lower end of only the outer pipe is submerged. In any event, a helical vane or other flow shaping device may be mounted on the outer surface of the inner pipe to span the annular space between the inner and outer pipes. The vanes impart a strong swirling action to an air or oxygen-enriched blast along that annulus and serve to enhance the cooling effect as well as ensure that gas is mixed well with fuel and feed material supplied through the inner pipe. The mixing occurs substantially in a mixing chamber defined by the outer pipe, below the lower end of the inner pipe where the inner pipe terminates a sufficient distance above the lower end of the outer pipe.

The outer pipe of the TSL lance wears and burns back at its lower end, but at a rate that is considerably reduced by the protective frozen slag coating than would be the case without the coating. However, this is controlled to a substantial degree by the mode of operation with TSL technology. The mode of operation makes the technology viable despite the lower end of the lance being submerged in the highly reactive and corrosive environment of the molten slag bath. The inner pipe of a TSL lance may be used to supply feed materials, such as concentrate, fluxes and reductant to be injected into a slag layer of the bath, or it may be used for fuel such as fuel oil, particulate coal or communuted plastics material. An oxygen containing gas, such as air or oxygen enriched air, is supplied through the annulus between the pipes. Prior to submerged injection within the slag layer of the bath being commenced, the lance is positioned with its lower end, that is, the lower end of the outer pipe, spaced a suitable distance above the slag surface. Oxygen-containing gas and fuel, such as fuel oil, fine coal or hydrocarbon gas, are supplied to the lance and a resultant oxygen/fuel mixture is fired to generate a flame jet which impinges onto the slag. This causes the slag to splash to form, on the outer lance pipe, the slag layer which is solidified by the gas stream passing through the lance to provide the solid slag coating mentioned above. The lance then is able to be lowered to achieve injection within the slag, with the ongoing passage of oxygen-containing gas through the lance maintaining the lower extent of the lance at a temperature at which the solidified slag coating is maintained and protects the outer pipe.

With a new TSL lance, the relative positions of the lower ends of the outer and inner pipes, that is, the distance the lower end of the inner pipe is set back, if at all, from the lower end of the outer pipe, is an optimum length for a particular pyrometallurgical process operating window determined during the design. The optimum length can be different for different uses of TSL technology. Thus, in a two stage batch operation for converting copper matte to blister copper with oxygen transfer through slag to matte, a continuous single stage operation for converting copper matte to blister copper, a process for reduction of a lead containing slag, or a process for the smelting an iron oxide feed material for the production of pig iron, all have a different respective optimum mixing chamber length. However, in each case, the length of the mixing chamber progressively falls below the optimum for the pyrometallurgical operation as the lower end of the outer pipe slowly wears and burns back. Similarly, if there is zero offset between the ends of the outer and inner pipes, the lower end of the inner pipe can become exposed to the slag, with it also being worn and subjected to burn back. Thus, at intervals, the lower end of at least the outer pipe needs to be cut to provide a clean edge to which is welded a length of pipe of the appropriate diameter, to re-establish the optimum relative positions of the pipe lower ends to optimize smelting conditions.

The rate at which the lower end of the outer pipe wears and burns back varies with the molten bath pyrometallurgical operation being conducted. Factors which determine that rate include feed processing rate, operating temperature, bath fluidity and chemistry, lance flows rates, etc. In some cases the rate of corrosion wear and burn back is relatively high and can be such that in the worst instance several hours operating time can be lost in a day due to the need to interrupt processing to remove a worn lance from operation and replace it with another, whilst the worn lance taken from service is repaired. Such stoppages may occur several times in a day with each stoppage adding to non-processing time. While TSL technology offers significant benefits, including cost savings, over other technologies, the lost operating time for the replacement of lances carries a significant cost penalty.

Our co-pending application PCT/AU2012/000751, filed on 27 Jun. 2012 discloses a new top submerged lance which enables a reduction in time lost through the need for lance replacement for repair. The features of the new lance of application PCT/AU2012/000751 are applicable to a wide range of top submerged lances in enabling adjustment, relative to the lower end of the outer pipe, of the lower end of the inner or next innermost pipe.

A sub-group of top submerged lances has become distinguished by designation as shrouded lances, for which the Outotec Ausmelt TSL technology is well known—see for example, Australian patent 640955 and its counterpart in U.S. Pat. No. 5,251,879 to Floyd. This sub-group is distinguished by the use of a further pipe, external to the typical lance outer pipe. The further pipe comprises a relatively short sleeve or shroud through which the main lance outer pipe extends and which is secured around the upper extent of the outer pipe. The shroud terminates at a location above the molten bath when the lance discharge end is submerged. The discharge of gas down into the reactor space, through a passage between the shroud and the outer pipe, adds to the cooling effect of gas passing through the lance for injection into the slag of the molten bath. The shroud thus assists in maintenance of a sufficient thickness of solidified slag coating on the lower extent of the outer pipe of the lance. The added cooling achievable with a shrouded lance is highly beneficial with a long lance length, particularly if a process with which the lance is used requires a limited flow rate of gas injected by the lance. The cooling effect provided by the shroud is also advantageous when the lance is required to be in operation for a long period. Also, in a furnace operating in the temperature range of about 1100° C. to about 1600° C., the thickness of solidified slag coating on the outer pipe of the lance decreases with increasing temperature. While for a given slag chemistry the amount of super heat generally is not large, use of high temperatures can be dictated by the slag chemistry or end product needs. Thus, added cooling enabled by gas supplied through the shroud becomes increasingly important at high temperatures in ensuring a coating of a sufficient thickness.

A shrouded lance has further important utility. In many instances it is required to supply gas to the reactor space above the molten slag. The gas may be an oxygen-containing gas, such as air or oxygen-enriched air, such as where post-combustion of gases evolved from the bath, or oxidation of evolved metal fume, is required. To serve this purpose the shroud outlet must be positioned correctly relative to the molten bath layer. Too close and any injected oxygen containing gas may interact with the main bath material. Too far away and any post combustion or oxidation reactions may be incomplete. Such reactions can also provide a heat transfer benefit where slag splashed from the bath is heated by these exothermic reactions and so recover some of this energy directly to the bath when the splashed material returns to the main volume of the bath. This ensures that the oxygen potential is controlled in the freeboard such that the slag maintains its conditions while the offgas is oxidized sufficiently to ensure smooth and optimal operation and conditioning of the offgas.

The present invention is directed to providing an improved shrouded lance for top submerged injection.

SUMMARY OF THE INVENTION

According to the present invention, there is provided a lance, for conducting a pyrometallurgical operation by top submerged lancing (TSL) injection, wherein the lance has at least inner and outer substantially concentric pipes, and wherein the lance further includes a shroud through which the outer pipe extends and which is mounted on and extends along an upper portion of the outer pipe to define with the outer pipe a passageway along which gas is able to be supplied for flow towards the outlet end of the outer pipe for discharge exteriorly of the lance, and the shroud is longitudinally adjustable relative to the outer pipe to enable substantial maintenance of, or variation in, a longitudinal spacing between the outlet ends of the shroud and the outer pipe. The lance optionally includes a helical vane or other flow shaping device extending longitudinally in an annular space between the outer pipe and the inner pipe or, where the lance has at least three substantially concentric pipes, between the outer pipe and a next innermost pipe between the outer pipe and the inner pipe. The lower outlet end of the inner pipe, or at least the pipe next innermost from the outer pipe, is set at a level relative to the lower, outlet end of the outer pipe required for the pyrometallurgical operation.

The lance may enable movement of the shroud relative to the outer pipe so as to maintain a substantially constant longitudinal spacing between the outlet ends of the shroud and the outer pipe. The arrangement may be such that maintenance of that spacing offsets wearing and burning back of the lower end of the outer pipe in use of the lance in a pyrometallurgical operation. To achieve that offset, relative movement between the shroud and the outer pipe may be continuous or stepwise in the course of the operation. For that purpose, the shroud may remain stationary relative to the reactor, with the outer pipe able to be lowered through the shroud to offset wear and burning back of its lower end.

Alternatively, the lance may enable movement of the shroud relative to the outer pipe to provide adjustment of the height of the shroud relative to the reactor. In this case, the shroud may be adjustable to provide a substantially constant spacing between the lower end of the shroud and the top surface of the molten bath as the volume of the bath increases, due to formation of slag and/or production of a molten or metal phase, or as a phase is tapped from the reactor in the course of the operation.

In a further alternative, the shroud may be adjustable relative to the outer pipe for the purpose of moving the shroud between active and inactive positions or between positions either to adjust the intensity of the cooling effect of gas discharged from the lower end of the shroud or to adjust the rate of heat energy transfer to the molten bath where that gas is for the purpose of post-combustion.

The shroud may be movable or adjustable relative to the outer pipe in accordance with a combination of two or more of those purposes. As a consequence, the shroud of the invention allows several benefits over conventional fixed shroud top submerged lances. These include:

- full control of the level of the lower end of the shroud and, hence, the level at which gas discharges from the shroud into the reactor space above the bath;
- an ability to adjust conditions in the reactor space above the bath from strongly oxidising through to strongly reducing;
- control over the extent of interaction between slag splashed by the submerged injection and, hence, the extent of heat energy from post-combustion that is taken up from the freeboard by the splashing slag phase of the bath; and
- control of offgas quality by, for example, reducing the content of $NO_x$, dioxins, labile sulphur and other species.

The lance of the invention may have its pipes in a fixed relationship, with provision made for longitudinal adjustment of the shroud relative to each of the pipes. Alternatively, the lance may have provision for the outer pipe to be longitudinally adjustable as disclosed in the above-mentioned application PCT/AU2012/000751, and this is assumed in the following. Thus, in one arrangement, the lower end of the inner pipe has substantially zero offset from the lower end of the outer pipe. In an alternative arrangement, the lower end of the inner pipe is set back from the lower end of the outer pipe so that a mixing chamber is defined between those ends.

The lance may have two pipes, with the helical vane connected at one longitudinal edge to the outer surface of the inner pipe and having its other longitudinal edged adjacent to the inner surface of the outer pipe. However, the pipe may have at least three pipes, with vane connected at the one edge to the outer surface of the pipe next innermost of the outer pipe, with its other edge adjacent to the vane surface of the outer pipe. In the latter case, the pipes other than the outer pipe may be either fixed or longitudinally movable relative to each other.

For use in a TSL pyrometallurgical operation, the lance is able to be suspended from an installation which is operable to raise and lower the lance as a whole relative to the TSL reactor. The installation is able to lower the lance into the TSL reactor to position the lower end of the lance above the surface of a slag phase, at the top of a molten bath in the reactor, to enable formation of a slag coating on the lance as detailed above. That is, such slag coating is formed on the outer surface of the lower extent of the outer pipe of the lance, and may also be formed on the outer surface of a lower extent of the shroud. The installation then is able to lower the lance to position the lower end of the lance in the slag phase and enable submerged injection within the slag, and to position the lower end of the shroud above the surface of the slag. The installation also is able to raise the lance from the reactor. In these movements, the lance is moved bodily. However, the installation also is operable to provide relative longitudinal movement between the shroud and the outer pipe, and preferably also between the inner and outer pipes of the lance. The relative longitudinal movement may be:

(a) raising or lowering of the shroud relative to the pipes of the lance to change the spacing between the outlet ends of the shroud and the outer pipe, to change the functioning of gas discharged through that end of the shroud;

(b) raising the shroud relative to the pipes of the lance to maintain a substantially constant spacing between the outlet ends of the shroud and the outer pipe as the lower end of the outer pipe wears and burns back; or (c) achieving movement as in (a) or (b), as the outer pipe is moved longitudinally relative to the inner pipe so as to maintain substantially constant, or to adjust, the relative positions of the outlet ends of the outer and inner pipes.

In each case, the relative longitudinal movement may be such as to maintain a substantially fixed relative positioning between the lower ends of the shroud, the outer pipe and the inner pipe. Thus, where the relative positioning is such as to provide a mixing chamber, the relative longitudinal movement most preferably is such as to maintain the mixing chamber at a substantially fixed, predetermined or selected length, while maintaining the lower ends of the shroud and outer pipe at a substantially fixed, predetermined or selected length. The accuracy with which the predetermined or selected lengths are maintained need only be substantially constant. Thus, the level of the outlet end of the inner pipe relative to the lower end of the outer pipe may be able to be maintained by relative movement between the inner and outer pipes to be within ±25 mm of a required level for the inner pipe. Similarly the level of the outlet end of the shroud relative to the lower end of the outer pipe may be able to be maintained to within ±25 mm of a required level for the shroud.

The lance, or an installation including the lance, may have a drive system by which the relative longitudinal movement, between the shroud and the outer pipe, and preferably also between the inner and outer pipes, is generated. The drive system may be operable to generate the movement at a predetermined rate, based on an assessment of an average rate at which the lower end of the outer pipe wears and burns back. Thus, if it is known for a given pyrometallurgical operation that the wear and burn back is about 100 mm in a four hour shift cycle, then the drive system may generate relative movement between the shroud and the outer pipe, and between the inner and outer pipes, of 25 mm per hour to maintain a substantially constant relative level for the shroud and a substantially constant relative positions for the shroud and for the lower ends of the pipes, such as a substantially constant mixing chamber length.

Use of a drive system providing such constant rate of relative movement between the shroud and the outer pipe, and between the inner and outer pipes, may be based on an assumption as to there being stable operating conditions resulting in a substantially constant rate at which the lower end of the outer pipe wears and burns back. However, the drive may be variable to accommodate a variation in operating conditions. The operating conditions may vary between successive operating cycles, or even within a given cycle, such as due to a change in the grade of a feed material or of a fuel and/or reductant, or due to an increase in the volume of the bath, such as due to an increase in the volume of slag and/or of a recovered metal or matte phase. Also, variation can occur between the stages of a given overall operation, such as between a white metal blow stage and a blister copper blow stage in a two stage copper matte converting process conducted in a single reactor or between successive stages of a three stage lead recovery process. The drive system may be adjustable either manually or by means of a remote control. Alternatively, the drive system may be adjustable in response to an output from at least one sensor able to monitor at least one parameter of the process. For example, the sensor may be one adapted to monitor the composition of reactor off-gases, the reactor temperature at a suitable location, gas pressure above the bath or in a gas off-take duct, the electrical conductivity of a component of the bath, such as the slag phase, the electrical conductivity of the outer pipe of the lance, or it may be an optical sensor for making an optical measure of the actual length of the outer pipe along the length of the lance between the shroud and the outer pipe, or between the inner and outer pipes, or combination of sensors for monitoring two or more of such parameters.

BRIEF DESCRIPTION OF THE DRAWINGS

In order that the invention may more readily be understood, description now is directed to the accompanying drawings, in which.

DETAILED DESCRIPTION OF THE DRAWINGS

Figure 1:
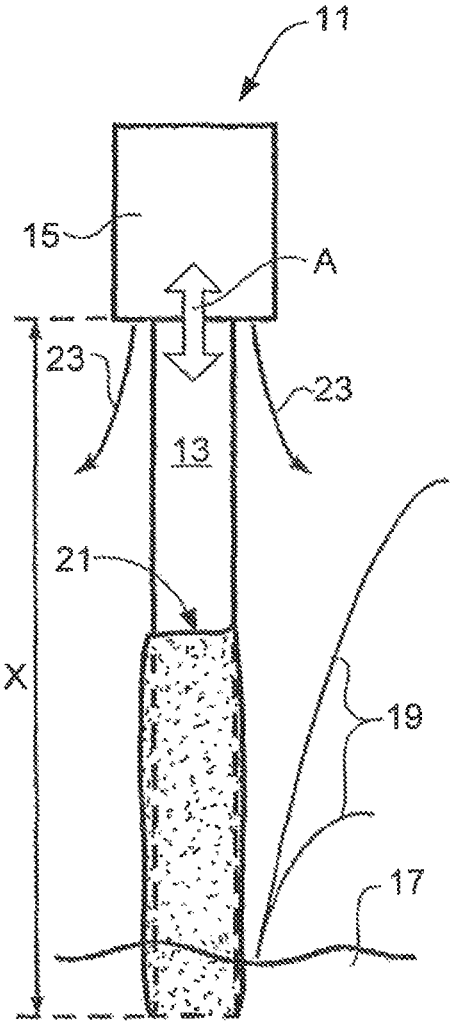
FIG. 1 schematically shows in side elevation a first form of lance in use in conducting a pyrometallurgical top submerged lancing operation.

FIG. 1 depicts a top submerged lance 11 which, schematically, is shown as in use. The lance 11 includes an outer pipe 13 through which at least an inner pipe (not shown) extends co-axially, and a shroud 15 which is concentric with an upper extent of the pipe 13. The lower end of the lance 11 is shown submerged in a layer of slag 17 of a molten bath contained in a top submerged lancing reactor (not shown). The extent of submergence is such that, while material passing down within outer pipe 13 is injected below the surface of slag 17, the lower end of shroud 15 is spaced above the upper surface of the slag 17.

The injection within slag 17 generates turbulence and splashing of the slag. The splashes are schematically shown by the lines 19, to the right of pipe 13 but, in reality, splashes would be generated around the full circumference of pipe 13. The lance 11 is suspended from an installation (not shown) by which it is able to be raised or lowered as a whole, as depicted by arrow A. Prior to the lance 11 being positioned to submerge its lower end, the lance 11 is positioned so that the lower end is just above the surface of the slag 17. Air then is blown from the lance 11 down onto the slag 17, to agitate the slag and generate splashes 19. This results in molten slag droplets covering the lower extent of the outer surface of outer pipe 13. The gas being blown through the lance cools the pipe 13 and solidifies the slag splashes 19 to build up a solidified slag coating 21. The lance 11 then is lowered by the installation to submerge the lower end of the lance 11. Despite being partially submerged, the coating 21 is able to be maintained by the cooling effect of injected gas despite the solidified slag being in contact with molten slag 17.

The height of the lower end of shroud 15 above the molten slag 17 may be such that, as shown, the outer surface of shroud 15 is not coated by splashes 19 to any significant extent. Gas, typically air or oxygen-enriched air, is able to be supplied through the annular space between shroud 15 and pipe 13 so as to flow down along pipe 13 and discharge into the reactor space above the surface of slag 17, as depicted by arrows 23. Despite the height of shroud 15, the gas flow 23 assists with keeping pipe 13 sufficiently cool for maintaining solid slag coating 21. Maintenance of coating 21 remains possible even when the gas of flow 23 is used for post-combustion of gases evolving from the molten bath to cause heat energy from post-combustion being taken up by slag splashes 19. The post-combustion may be of metal vapours, free sulphur, hydrogen and/or carbon monoxide, $NO_x$ and/or dioxins and other toxic organics.

In known forms of shrouded lance the shroud is of fixed length, and the distance by which the outlet end of the shroud is spaced from the outlet end of the outer pipe can be varied only by cutting a section from the lower end of the shroud, or welding a further length to the existing shroud. Thus, the shroud is fixed and adjustment of the shroud essentially requires manual operation, not suited to relatively fine adjustment, while the lance is out of service.

In contrast to the known form of shrouded lance, shroud 15 is adjustable on the upper end of pipe 13 to enable variation in the spacing X between the lower end of shroud 15 and the lower outlet end of pipe 13. There is a number of different arrangements by which the spacing X can be varied. In a first arrangement, shroud 15 is adjustably mounted on the upper end of pipe 13 so as to be reversibly movable as a whole along the pipe. In a second arrangement, the shroud 15 is fixed in relation to pipe 13, but with shroud 15 variable in length so that its lower end can be extended towards, or retracted from, the lower end of pipe 13, to decrease or increase, respectively, the distance X. In one form of the second arrangement, the shroud 15 may comprise at least two longitudinally overlapping telescopic sections of which one is fixed in relation to pipe 13 while the or each other section is longitudinally slidable relative to the fixed section.

In another form of second arrangement, shroud 15 again comprises at least two longitudinally overlapping sections of which one is fixed or secured in relation to the outer pipe, with the sections being adjustable by screw threaded engagement by which at least one section can be extended or retracted.

With the arrangement of FIG. 1 as illustrated the spacing X, for the depth of submergence of the pipe 13, is such that a slag coating has not formed on shroud 15. This, of course, could change for a greater depth of submergence, a rising level of slag in the course of a pyrometallurgical operation, or with either lowering of shroud 15 on pipe 13 or an increase in the length of shroud 15 lessening the spacing X. Also, some dust or other deposits could collect on the outer surface of shroud 15. In view of a possible slag or dust coating forming on shroud 15, it is preferred with each form of the second arrangement that the innermost section of shroud 15 is fixed in relation to pipe 13, so that it is not exposed over the range of variation in the length X, even when the outer section is fully retracted.

Figure 2:
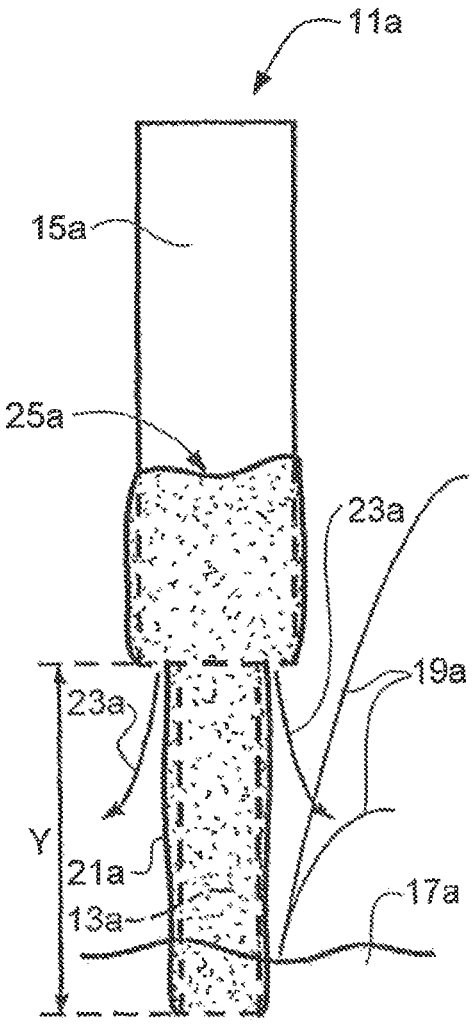
FIG. 2 corresponds to FIG. 1, but shows a second form of lance.

FIG. 2 shows an alternative form of lance 11*a*. The arrangement of this will be readily understood from the description of lance 11 of FIG. 1. The features shown in FIG. 2 have the same reference numerals as in FIG. 1, but distinguished by the suffix "a".

The arrangement for lance 11*a* differs principally in that shroud 15*a* is longer, resulting in a distance Y between its lower end and the lower end of outer pipe 13*a* which is substantially less than the distance X for lance 11 of FIG. 1. As a consequence, the slag coating 25*a* has formed on shroud 15*a* in addition to the coating 21*a* on pipe 13*a*. As can be seen, the thickness of coating 21*a* on pipe 13*a* is not such as to block the lower end of the annular space between shroud 15*a* and pipe 13*a* when the shroud 15*a* is in the lower most position, that is, with the distance Y at a minimum value for the range obtainable with adjustment of shroud 15*a* relative to pipe 13*a*.

The smaller spacing Y compared to spacing X results in shroud 15*a* providing increased protection for outer pipe 13*a* against radiant heat energy. Also, the gas supplied through the annular space between shroud 15*a* and pipe 13*a* is able to provide cooling over a greater length of pipe 13*a*. This assists in maintaining the solid slag coating 21*a* on pipe 13*a*, even over the submerged portion in contact with molten slag 17*a*. That added cooling can be beneficial in enabling maintenance of the solid slag coating 21*a* even where oxygen-containing gas discharging from the lower end of the shroud 15*a* is used for post-combustion close to the surface of the slag 17 so that there is a high take-up by the slag of heat energy generated by the post-combustion.

The lances 11 and 11*a* of FIGS. 1 and 2 are able to be used with a drive system. This may be as described earlier herein, or as described with reference to FIGS. 3 and 4.

Figure 3:
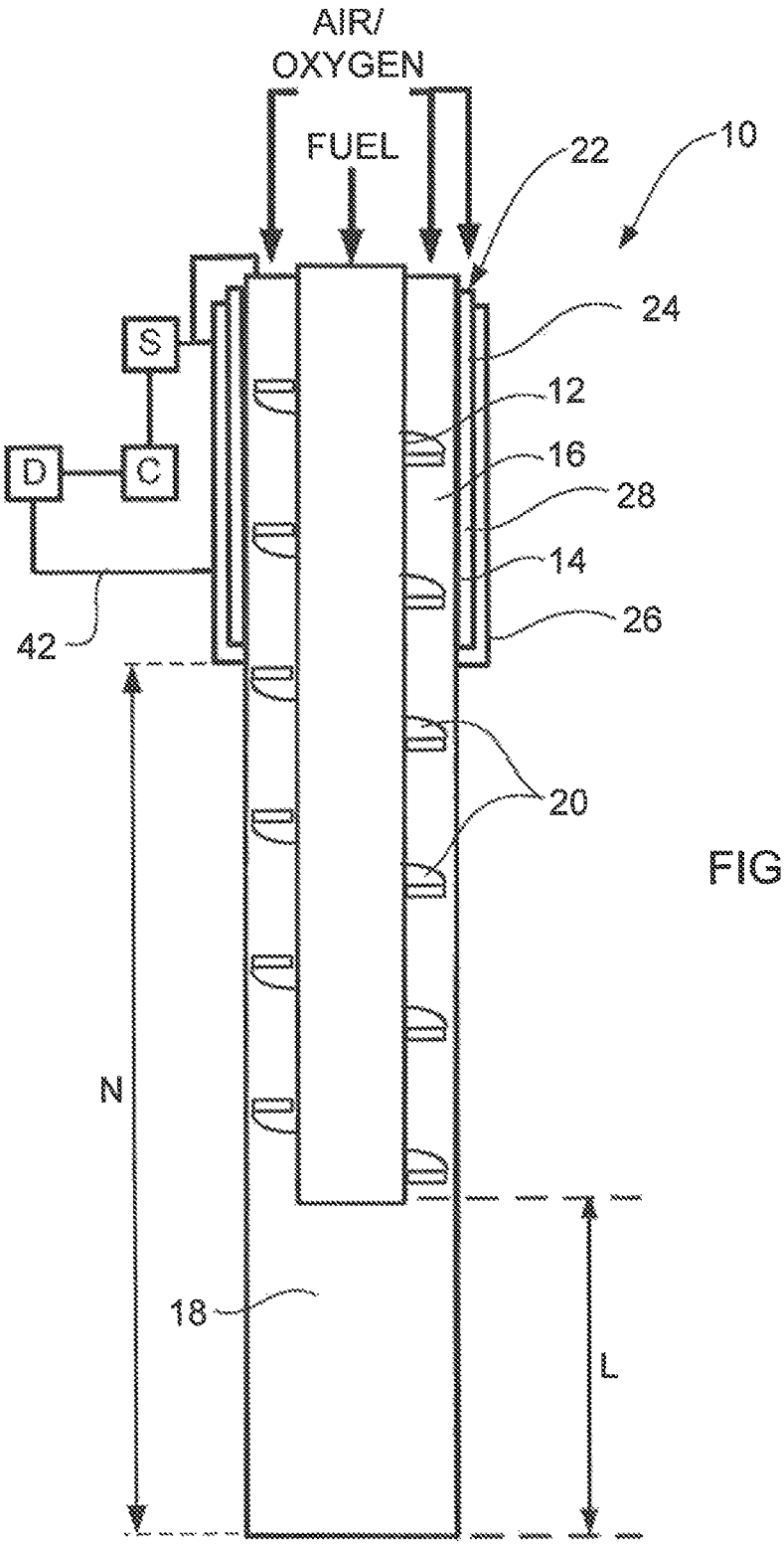
FIG. 3 is a schematic representation of a sectional view of a third form of lance for TSL pyrometallurgical operations.

The lance 10 of FIG. 3 has two concentric steel pipes of circular cross-section. These include an inner pipe 12 and an outer pipe 14. An annular passage 16 is defined between the pipes 12 and 14. Along the passage 16 helical vanes or baffles 20 may be used to enhance cooling. The or each section of the baffle is provided by a strip or ribbon which extends helically around pipe 12, and has one edge welded to the outer surface of pipe 12, while its other edge is closely adjacent to the inner surface of outer pipe 14. The form of the baffle may be similar to that of the swirler strips 14 shown in FIG. 2 of U.S. Pat. No. 4,251,271 to Floyd.

The lance 10 also includes an annular shroud 22 concentric with pipes 12 and 14 and mounted on the upper end of outer pipe 14. The shroud 22 has two concentric sleeves comprising an inner sleeve 24 fixed in relation to pipes 12 and 14, and an outer sleeve 26 which is longitudinally adjustable on the inner sleeve 24. By lowering or raising outer sleeve 26 on inner sleeve 24, the spacing N, between the lower end of sleeve 26 and the lower outlet end of outer pipe 14, is able to be varied between a maximum, as illustrated, and a minimum.

The sleeve 26 may be telescopically slidable on sleeve 24. In that case, one of the sleeves may have ridges or teeth which mesh with grooves defined in the other sleeve, to provide a spline coupling. The ridges or teeth and the grooves may extend parallel to the axis of lance 10, or helically around that axis, so that sleeve 26 may move linearly along sleeve 24 or rotate to move both longitudinally and circumferentially. In the latter case, the sleeves 24, 26 may have helical ridges and grooves, respectively, which define a threaded coupling between the sleeves.

The lower end of inner pipe 12 is spaced above the lower end of outer pipe 14 by the distance L. This results in a chamber 18 in the extent of pipe 14 below pipe 12, which functions as a mixing chamber.

In the simple arrangement illustrated, air, oxygen or oxygen-enriched air is supplied to the passage 16, at the upper end of lance 10. A suitable fuel with any required conveying medium is supplied into the upper end of pipe 12. The helical baffle in passage 16 imparts strong swirling action to the gas supplied to passage 16. Thus, the cooling effect of the gas is enhanced and the gas and fuel are intimately mixed together in chamber 18 with the mixture able to be fired to produce efficient combustion of the fuel and generation of a strong combustion flame issuing from the lower end of lance 10. The ratio of oxygen to fuel can be varied, depending on the strength of reducing or oxidising conditions to be generated at or below the lower end of the lance. Oxygen or fuel not consumed in the combustion flame is injected within the slag of the bath, with any component of the fuel which is not combusted in the combustion flame being available within the slag as reductant. For this reason it often is indicated in TSL injection that fuel/reductant is injected by the lance.

In addition to the supply of oxygen or oxygen-enriched air being supplied to the passage 16, air, oxygen or oxygen-enriched air is supplied to the upper end of a passage 28 defined by shroud 22 and pipe 14. The gas supplied to passage 28 may be the same or differ from the gas supplied to passage 16. The length of passage 28 corresponds to the spacing between the upper end of sleeve 24 and the lower outlet end of sleeve 26 and varies with extension or retraction of sleeve 26 relative to sleeve 24. Gas supplied along passage 28 serves to cool outer pipe 14 and, on discharging at the lower end of shroud 22, enables post-combustion, such as of metal vapours, free sulphur, hydrogen, carbon monoxide, $NO_x$ and/or organics such as dioxins, which evolves from a molten bath in which lance 10 is used in conducting a pyrometallurgical process or operation.

Figure 4:
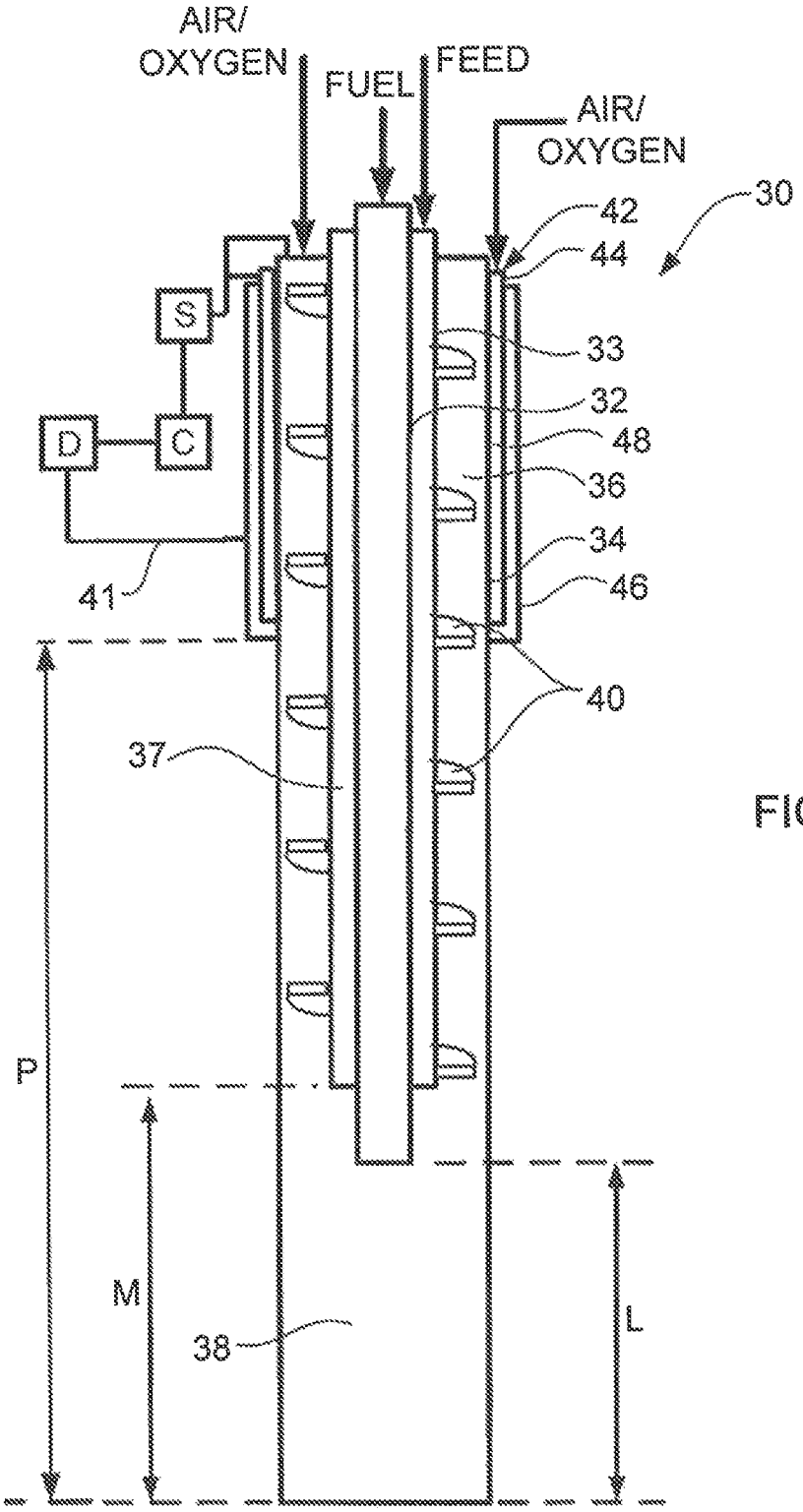
FIG. 4 corresponds to FIG. 3, but shows a schematic representation of a fourth form of lance for such operations.

The arrangement for lance 30 shown in FIG. 4 will be understood from the description of FIG. 3. Corresponding parts have the reference as FIG. 3, plus 20. The difference in this instance is that the lance 30 has three concentric pipes, due to a third pipe 33 being positioned between inner and outer pipes 32 and 34. Thus, passage 36 and swirler 40 are between pipes 33 and 34. Also, then lower end of pipe 33 is set back from the lower end of pipe 34 by a distance (M-L), where M is the distance between the lower ends of pipes 33 and 34 and L is the distance between the lower ends of pipes 32 and 33. Thus, the mixing chamber 38 has an annular extension around the length of pipe 32 which is below the end of pipe 33.

Again, a helical baffle (not shown) is provided. However, in this instance, the baffle is mounted on the outer surface of pipe 33 and extends across passage 36 so that its outer edge is close to the inner surface of pipe 34. Again, the lance 30 of FIG. 4 has a shroud 42 with a sleeve 44 secured to pipe 34 and a sleeve 46 adjustable on sleeve 44 to vary the distance P.

In this embodiment of a lance 30, fuel is supplied at the upper end of pipe 32, while free-oxygen containing gas is supplied through pipe 34, along passage 36 between pipes 33 and 34 and along passage 48 between shroud 42 and pipe 34. Also, feed material, such as concentrate, granular slag or granular matte, plus flux, may be supplied through pipe 33, along the annular passage 37 between pipe 32 and pipe 33. The mixing of oxygen containing gas and feed commences before the end of pipe 32 and the gas/feed mixture then is mixed with fuel below the end of pipe 32. Again, the fuel is combusted in mixing chamber 36, while the feed can at least be pre-heated, possibly partly melted or reacted, before being injected within the slag layer of a reactor into which lance 30 extends.

Figure 5:
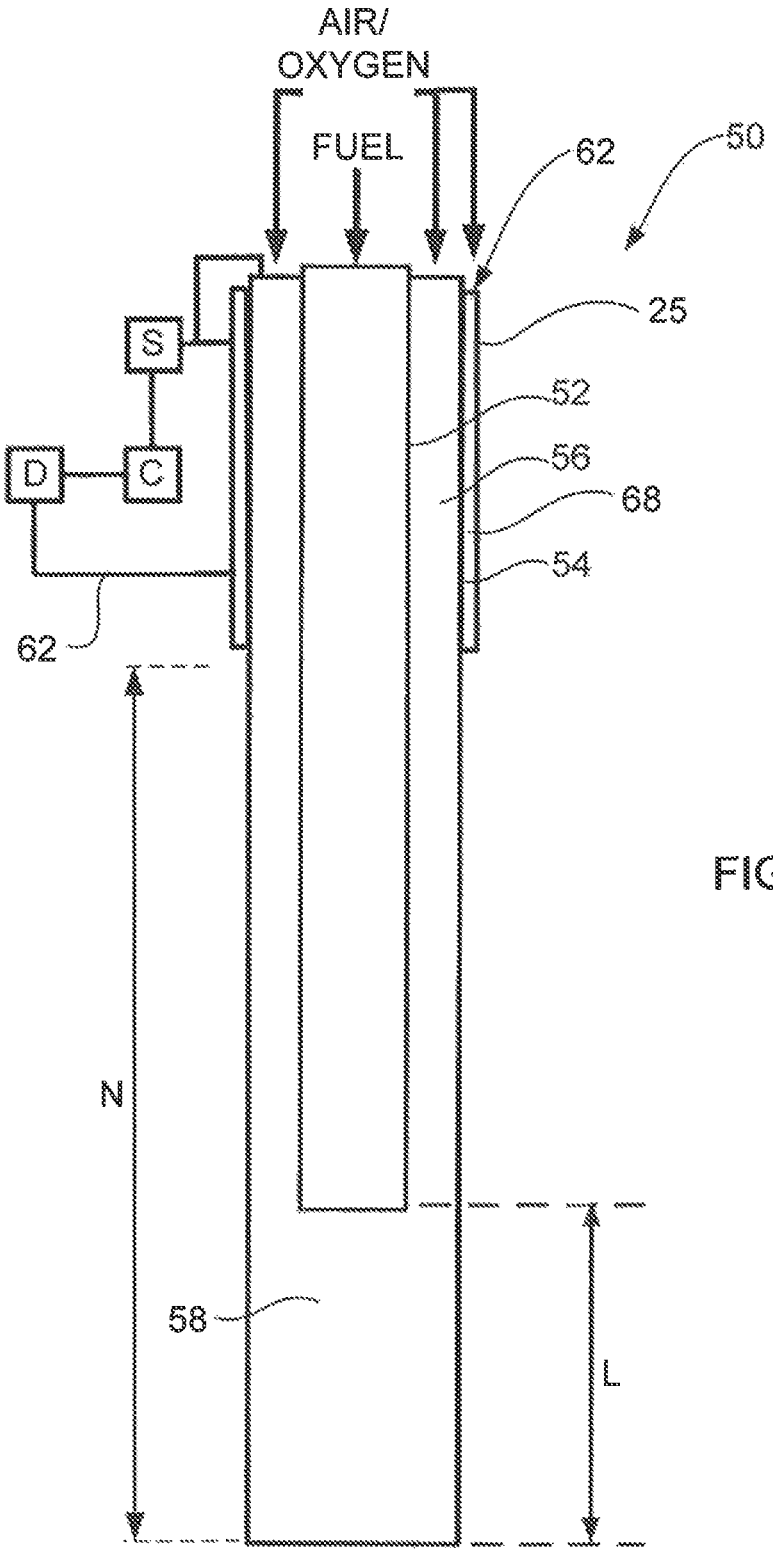
FIG. 5 corresponds to FIG. 3, but shows a schematic representation of a fifth form of lance for such operations.

FIG. 5 shows a variant of the lance 10 of FIG. 3. A similar variant could be based on the lance 30 of FIG. 4. The parts of the lance of FIG. 5 which correspond to those of lance 10 have the same reference numeral, plus 40.

The lance 50 of FIG. 5 readily will be understood from the description of lance 10. One difference is that a helical baffle is not provided, however they may be used. Also, the shroud 62 comprises only a single sleeve 25 which is adjustable as a whole along lance outer pipe 54. The adjustment may be such as described for adjustment of outer sleeve 26 on inner sleeve 24 of shroud 22 of lance 10.

As one skilled in the art would appreciate, the indicated feed arrangements in FIGS. 3 to 5 are examples only of variations to the central concept. The injection annulus or passage chosen for the various gases and solids may be varied without affecting the nature of the invention, as may be the use or not of swirlers or baffles within.

Each of lances 10, 30 and 50 is able to be used in a variety of pyrometallurgical operations, for the production of various metals from a range of primary and secondary feeds, and in the recovery of metals from a range of residues and wastes. The lances 10, 30 and 50 consist of concentric pipes and while two or three pipes are usual, there can be at least one further pipe in lances for some special applications. The lances can be used to inject feeds, fuel and process gases into a molten bath.

In all cases, the pipes of the lance are of a fixed operating length below the roof of a TSL reactor in which the lance is to be used. More specifically, the lance position is relative to the bath, and the overall lance length is typically long enough to reach a fixed distance from the furnace hearth. However, each of lances 10, 30 and 50 preferably is adjustable for the purpose of maintaining a substantially constant length for the respective mixing chamber 16 and 36 required for a particular pyrometallurgical operation. In the case of lances 10 and 50, the arrangement enables the length L to be kept substantially constant, despite wear and burn back of the lower end of pipe 14 which otherwise would reduce the length L. Similarly, in lance 30, the arrangement enables each of the lengths L and M to be kept substantially constant, despite wear and burn back of the lower end of pipe 34 which otherwise would reduce the lengths L and M. Thus, the length L in lances 10 and 50, and the lengths L and M in the case of lance 30 can be maintained at settings providing optimum conditions for top submerged lancing injection of a required pyrometallurgical operation and for required operating conditions.

In the case of lance 30, the passages 36 and 37 enable different materials to be isolated from each other until the materials discharge into chamber 38 and mix. The lance may have at least one further pipe, resulting in a further passage through which a still further material can pass. The at least one further pipe may have a set back distance corresponding to L or M or a distance other than L and M. Also, in lance 30, each of L and M, and the set back distance of any further pipe, may be adjustable to compensate for a required change in operating conditions.

The lances 10 and 30 are shown as having a drive system D of any of a variety of different forms. While each system D is shown as spaced from the respective lance 10, 30 and operatively connected by a line or drive link 41, drive system D may be mounted on lance 10, 30, on an installation from which the lance is suspended, or on some adjacent structure, depending on the nature of system D. Thus, line or link 41 may be a direct mechanical drive by which the outer sleeve of the respective shroud 22, 42 is able to adjust longitudinally relative to the inner sleeve. The link also may enable one pipe to be moved longitudinally relative to another in order to compensate for wear or burn back of the lower end of the outer pipe. Alternatively, the line or link 41 may denote action of system D through a coupling to an installation by which the lance 10, 30 is suspended. In each case, the system D may be operable on a set time-controlled basis, to impart a fixed rate of relative movement between the lance sleeves and preferably between pipes of lance 10, 30. Alternatively, the drive may be operable in response to a signal generated by a control unit C. The arrangement may be such that the signal is adjustable in response to an output from a sensor S which is monitored by control unit C. The sensor may be positioned and operable to provide an output indicative of variation in the length L and M caused by wear and burn back of the lower end of the outer sleeve of lance 10 and 30.

The drive system D and the sensor S may be operable or of a nature detailed earlier herein.

The lance of the present invention is able to provide numerous benefits over conventional top submerged lances with a fixed shroud. These benefits include:

(a) Where lance wear and burn back is unavoidable, the required spacing between the outlet ends of the shroud and the outer pipe is able to be substantially maintained. This enables an optimum setting be retained throughout a pyrometallurgical operation.

(b) Where a pyrometallurgical operation is conducted in a sequence of stages requiring differing operating conditions, the shroud is able to be retracted if not required in a given stage or positioned as required for each stage.

(c) Control of the process parameters including post combustion, offgas control and interaction of splashed slag with reactions occurring in the upper furnace region.

Finally, it is to be understood that various alterations, modifications and/or additions may be introduced into the constructions and arrangements of parts previously described without departing from the spirit or ambit of the invention.

What is claimed is:

1. A lance, for conducting a pyrometallurgical operation by top submerged lancing (TSL) injection, the lance having at least inner and outer substantially concentric pipes with a lower outlet end of the inner or at least the next innermost pipe set at a level higher relative to the lower outlet end of the outer pipe required for the pyrometallurgical operation; wherein the lance further includes a shroud through which the outer pipe extends and which is mounted on and extends along an upper portion of the outer pipe to define with the outer pipe a passageway along which gas is able to be supplied for flow towards the outlet end of the outer pipe for discharge exteriorly of the lance, and the shroud is adjustably mounted relative to the outer pipe for longitudinal adjustment relative to the outer pipe whilst the lance is in use during a pyrometallurgical operation to enable substantial maintenance of or variation in a longitudinal spacing between the outlet ends of the shroud and the outer pipe, and wherein the lance is suspended from an installation which is operable to raise or lower the lance as a whole relative to a TSL reactor and is operable to provide relative longitudinal movement between the shroud and the outer pipe, and the lance further includes a drive system by which the relative longitudinal movement between the shroud and the outer pipe is generated, and wherein the lance further includes a helical vane or other flow shaping device extending longitudinally in an annular space between the outer pipe and the inner pipe or, where the lance has at least three substantially concentric pipes, between the outer pipe and a next innermost pipe between the outer pipe and the inner pipe.

2. The lance of claim 1, wherein movement of the shroud relative to the outer pipe is enabled so as to maintain a substantially constant longitudinal spacing between the outlet ends of the shroud and the outer pipe to offset wearing and burning back of the lower end of the outer pipe in use of the lance in a pyrometallurgical operation such as to maintain/control chemical potentials in slag and offgas.

3. The lance of claim 2, wherein relative movement between the shroud and the outer pipe is continuous or stepwise in the course of the pyrometallurgical operation.

4. The lance of claim 3, wherein the shroud remains stationary relative to a reactor including the lance when the outer pipe is lowered through the shroud to offset wear and burning back of its lower end.

5. The lance of claim 3, wherein the lance enables movement of the shroud relative to the outer pipe to provide adjustment of the height of the shroud relative to a reactor including the lance by the shroud being adjustable to provide a substantially constant spacing between the lower end of the shroud and the top surface of the molten bath as the volume of the bath changes due to formation of slag and/or production of a molten or metal phase or as a phase is tapped from the reactor in the course of the pyrometallurgical operation.

6. The lance of claim 3, wherein the shroud is adjustable relative to the outer pipe for the purpose of moving the shroud between active and inactive positions or between positions either to adjust the intensity of the cooling effect of gas discharged from the lower end of the shroud or to adjust the rate of heat energy transfer to a molten bath where that gas is for the purpose of post-combustion.

7. The lance of claim 1, wherein the pipes are in a fixed relationship, with provision made for longitudinal adjustment of the shroud relative to each of the pipes.

8. The lance of claim 1, wherein the shroud is adjustably mounted on the outer pipe to enable the shroud as a whole to move along the outer pipe.

9. The lance of claim 1, wherein the shroud comprises at least two concentric sleeves, with one of the sleeves fixed in relation to the outer pipe and at least one other sleeve adjustable relative to the fixed sleeve and the outer pipe.

10. The lance of claim 1, wherein the relative positions of the inner and outer pipes are longitudinally adjustable to enable the length of a mixing chamber, defined between the lower end of the outer pipe and the lower end of the next pipe, to be maintained at a desired setting during a period of use to compensate for the lower end of the outer pipe wearing and burning back.

11. The lance of claim 10, wherein the lower end of the inner pipe has substantially zero offset from the lower end of the outer pipe.

12. The lance of claim 10, wherein the lower end of the inner pipe is set back from the lower end of the outer pipe so that a mixing chamber is defined between those ends.

13. The lance of claim 10, wherein the lance has at least three pipes, with the vane connected at one longitudinal edge to the outer surface of the pipe next innermost of the outer pipe, and with its other edge adjacent to the inner surface of the outer pipe.

14. The lance of claim 13, wherein the pipes other than the outer pipe are longitudinally fixed relative to each other.

15. The lance of claim 1, wherein the lance enables relative longitudinal movement between the inner and outer pipes by an installation lowering mounting by which the lance as a whole is supported as the inner pipe is raised relative to the mountings or the lance enables relative longitudinal movement between the inner and outer pipes by the outer pipe being lowered while the inner pipe is held stationary.

16. The lance of claim 1 wherein the level of the outlet end of the shroud relative to the lower end of the outer pipe is able to be maintained by relative movement between the shroud and outer pipe to be within ±25 mm of a required level for the inner pipe.

17. The lance of claim 1, wherein the drive system is operable to generate relative movement at a predetermined substantially constant rate.

18. The lance of claim 1, wherein the drive system is variable speed to accommodate a variation in operating conditions in which the lance is used.

19. The lance of claim 1, wherein the drive system is adjustable manually.

20. The lance of claim 1, wherein the drive system is adjustable by remote control.

21. The lance of claim 1, wherein the lance includes or has an associated sensor able to monitor at least one parameter of a pyrometallurgical operation and to provide an output by which the drive system is adjustable.

* * * * *